US006095099A

United States Patent [19]

Morohoshi et al.

[11] Patent Number: 6,095,099

[45] Date of Patent: Aug. 1, 2000

[54] ENGINE OPERATED WORKING MACHINE

[75] Inventors: Shinichi Morohoshi; Tomohiro Hirano; Ryuji Tsuru, all of Wako, Japan

[73] Assignee: Honda Giken Kogyo Kabushiki Kaisha, Tokyo, Japan

[21] Appl. No.: 09/272,501

[22] Filed: Mar. 19, 1999

[30] Foreign Application Priority Data

Apr. 17, 1998 [JP] Japan ..... 10-107528

[51] Int. Cl.[7] ..... F02B 63/00

[52] U.S. Cl. ..... 123/2; 123/41.57

[58] Field of Search ..... 123/2, 198 E, 123/41.57; 290/1 A, 1 B; 181/204, 220, 259, 262, 229

[56] References Cited

U.S. PATENT DOCUMENTS 4,608,946 9/1986 Tanaka et al. ..... 123/2
4,677,940 7/1987 Bracht et al. ..... 123/2
4,917,201 4/1990 Fujikawa et al. ..... 123/41.57
6,039,009 3/2000 Hirose ..... 123/2

FOREIGN PATENT DOCUMENTS 643777 2/1989 Japan .

*Primary Examiner*—John Kwon
*Attorney, Agent, or Firm*—Carrier, Blackman & Associates, P.C.; Joseph P. Carrier; William D. Blackman

[57] ABSTRACT

An engine operated working machine includes an engine and a working machine to be driven by the engine surrounded by a soundproof case. An exhaust compartment housing a muffler is formed in the soundproof case. An exhaust pipe connected with the muffler is bent in a direction so as to direct exhaust gas discharged therefrom away from an exhaust air opening of the exhaust compartment and has an opening positioned apart from the exhaust air opening. Cooling air forced into the exhaust compartment flows around the muffler and the exhaust pipe to cool them. Exhaust gas discharged from the exhaust pipe into the exhaust compartment is mixed with the cooling air to change a discharging direction thereof and is then discharged outside of the soundproof case through the exhaust air opening.

17 Claims, 8 Drawing Sheets

ENGINE OPERATED WORKING MACHINE

BACKGROUND OF THE INVENTION

1. Field of the Invention

The present invention relates to an engine operated working machine covered by a soundproof case entirely, particularly to such a machine constructed to reduce exhaust sound level and flow velocity of exhaust discharged outside of the soundproof case.

2. Discussion of Relevant Art

Engine operated working machine having an engine combined integrally with a generator, an air compressor or a water lifting pump are known, and are used at on a construction work site, generally. Many of the engine operated working machines are covered by soundproof cases entirely in order to reduce operation noise at a lowest level possible, in view of working environment or taking influences on a local society into consideration in case of operating the machines in a town especially at night.

This kind of engine operated working machine is made so that the number of openings such as a suction port and an exhaust port is fewest possible and the sizes of the openings are small in order to attain quiet operation. Therefore, on the one hand, some sufficient measures become necessary with regard to poor cooling ability within the soundproof case caused by the small area of the openings.

Regarding such a problem, an engine operated working machine as shown in Japanese Utility Model Publication No. Sho 64-3777 has been proposed. In this machine, an engine and a muffler are covered by a duct to be isolated from other instruments within the soundproof case and cooling air is forced into the duct to be discharged from the muffler side of the duct toward the outside of the soundproof case, so that re-circulation of hot exhaust cooling air into the soundproof case can be prevented and the instruments can be arranged utilizing the space within the soundproof case effectively.

In the above proposed machine, an exhaust port for discharging the exhaust cooling air from the soundproof case is disposed on an extended line of an exhaust pipe as shown in FIG. 4 of the Japanese Publication. Therefore, the exhaust cooling air is discharged forcibly by an exhaust gas from the muffler, but directness of the exhaust gas and the exhaust cooling air at the exhaust port is intense and sometimes a large exhaust sound is felt.

SUMMARY OF THE INVENTION

The present invention relates to an improvement of the previously proposed engine operated working machine in which the above-mentioned difficulties are overcome. According to the present invention there is provided an engine operated working machine having a soundproof case surrounding an engine and a working machine to be driven by the engine, comprising: an exhaust compartment formed within the soundproof case, having an exhaust air opening; means for forcing cooling air into the exhaust compartment; a muffler put in the exhaust compartment; and an exhaust pipe connected to the muffler, bent in a direction so as to keep away from the exhaust air opening of the exhaust compartment, and having a discharge opening positioned apart from the exhaust air opening, such that cooling air forced into the exhaust compartment flows around the muffler and the exhaust pipe to cool the muffler and the exhaust pipe, and exhaust gas discharged from the exhaust pipe into the exhaust compartment is mixed with the cooling air to change a discharging direction thereof and is then discharged outside of the soundproof case through the exhaust air opening.

According to the invention, the muffler and the exhaust pipe are effectively cooled by the cooling air which is forced into the exhaust compartment and flows around the muffler and the exhaust pipe connected to the muffler. The exhaust gas discharged from the exhaust pipe is sufficiently mixed with the exhaust cooling air which has cooled the muffler and the exhaust pipe, so that temperature of the exhaust gas discharging from the exhaust opening is lowered and also velocity of the exhaust gas is lowered.

The discharging direction of the exhaust gas from the exhaust pipe connected to the muffler may be parallel with a plane of the exhaust air opening. The exhaust gas discharged into the exhaust compartment from the exhaust pipe intersects the cooling air flowing toward the exhaust air opening after passing around the muffler and the exhaust pipe to be mixed with the cooling air, so that an impartial temperature distribution of the exhaust at the exhaust opening can be obtained.

Since the discharging direction of the exhaust pipe is parallel with a plane of the exhaust air opening, the sound of exhaust discharged from the exhaust pipe into the soundproof case does not directly reach the exhaust air opening of the soundproof case, but is reflected and absorbed by the inner surfaces of the soundproof case. Thus, the noise level of the exhaust sound discharged from the exhaust air opening of the soundproof case is sharply lowered compared with the noise level of the exhaust sound discharged from the exhaust pipe.

The exhaust opening of the exhaust pipe is not seen from the outside through the exhaust air opening of the soundproof case, so that the engine operated working machine exhibits a good appearance.

A tip end of the exhaust pipe connected to the muffler may be closed, and the opening of the exhaust pipe may be positioned halfway between the muffler and the tip end. In this case, exhaust noise propagated into the exhaust pipe from an exhaust port of the engine is reflected at the closed tip end of the exhaust pipe to interfere with a succeeding exhaust noise, so that level of exhaust noise emitted from the opening positioned halfway is greatly reduced.

According to another aspect of the invention, the above-mentioned engine operated working machine comprises a duct covering the engine and the muffler for thermally isolating them from other instruments within the soundproof case; a side of the duct opening inside of the soundproof case; another side of the duct wherein the muffler is positioned opening toward the outside of the soundproof case; and a fan driven by the engine to inhale air within the soundproof case into the duct through the side of the duct opening inside of the soundproof case, such that the air flows around the engine and the muffler in order to cool them and discharges outside of the soundproof case through the other side of the duct.

The above-mentioned other instruments isolated by the duct are, thereby; not so much influenced by heat emitted from heat emitting instruments such as the engine and the muffler. The heat emitting instruments are cooled efficiently by the cooling air forced into the duct by the fan.

Noise sources such as the engine and the muffler are covered not only by the duct, but the soundproof case as well so that a very high soundproof ability can be obtained.

In this engine operated working machine, a cylinder of the engine may be inclined laterally along a vertical plane perpendicular to a rotary axis of the engine, and the muffler may be disposed in a space above the cylinder directed perpendicularly to the rotary axis. A relatively large space for arranging the muffler is thus formed above the engine so that a vertical size of the soundproof case can be shortened and remarkable miniaturization of the engine operated working machine can be achieved.

Because the muffler of high temperature is disposed above the cylinder, the engine can avoid contact with heat emitted from the muffler and a load of the cooling system for the engine is reduced. The cooling air forced into the duct, makes a heat exchange with the engine and is smoothly led upwardly to the exterior through the exhaust air opening of the soundproof case by the high temperature exhaust gas discharged from the exhaust pipe at an intermediate portion of the pipe and muffler cooing air heated by the muffler. Therefore, a very high cooling performance can be obtained.

DETAILED DESCRIPTION OF THE PRESENTLY PREFERRED EMBODIMENT

Hereinafter, an engine operated generator 1 shown in FIGS. 1 to 8, which is a preferred embodiment of an engine operated working machine according to the present invention, will be described.

Figure 1:
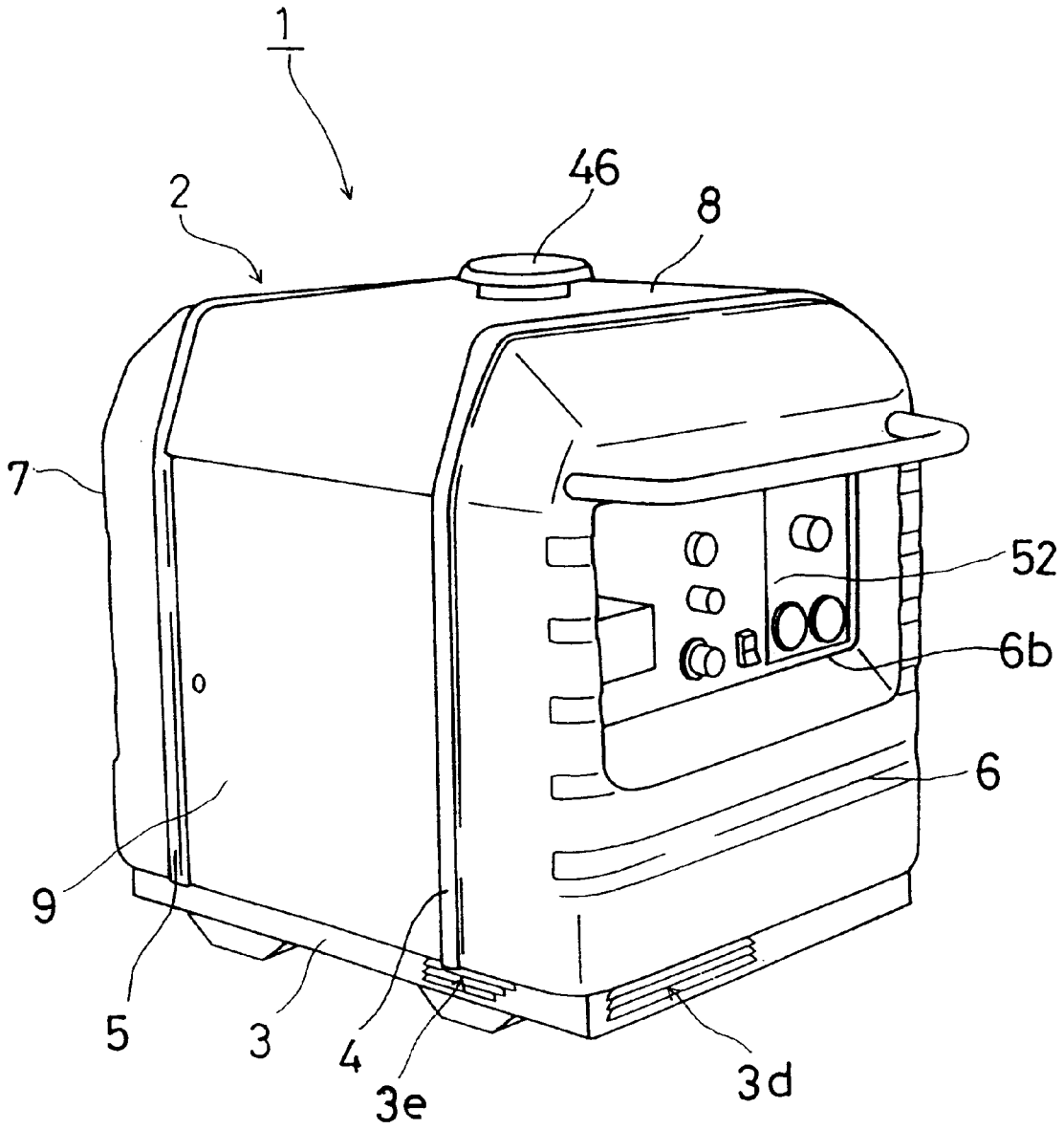
FIG. 1 is an perspective outside view of an engine operated generator which is an embodiment of the engine operated working machine according to the present invention.

As shown in FIG. 1, a soundproof case 2 of the engine operated generator 1 comprises a flat saucer-like under frame 3, a rectangular-box-like front cover 6 covering a front frame 4 erected at a front portion of the under frame 3, a rectangular-box-like rear cover 7 covering a rear frame 5 erected at a rear portion of the under frame 3, a center cover 8 attached to the front frame 4 and the rear frame 5 between the front cover 6 and the rear cover 7, and a lid member 9 attached to the front frame 4 and the rear frame 5 for opening and closing at a right bottom side of the soundproof case 2.

Figure 2:
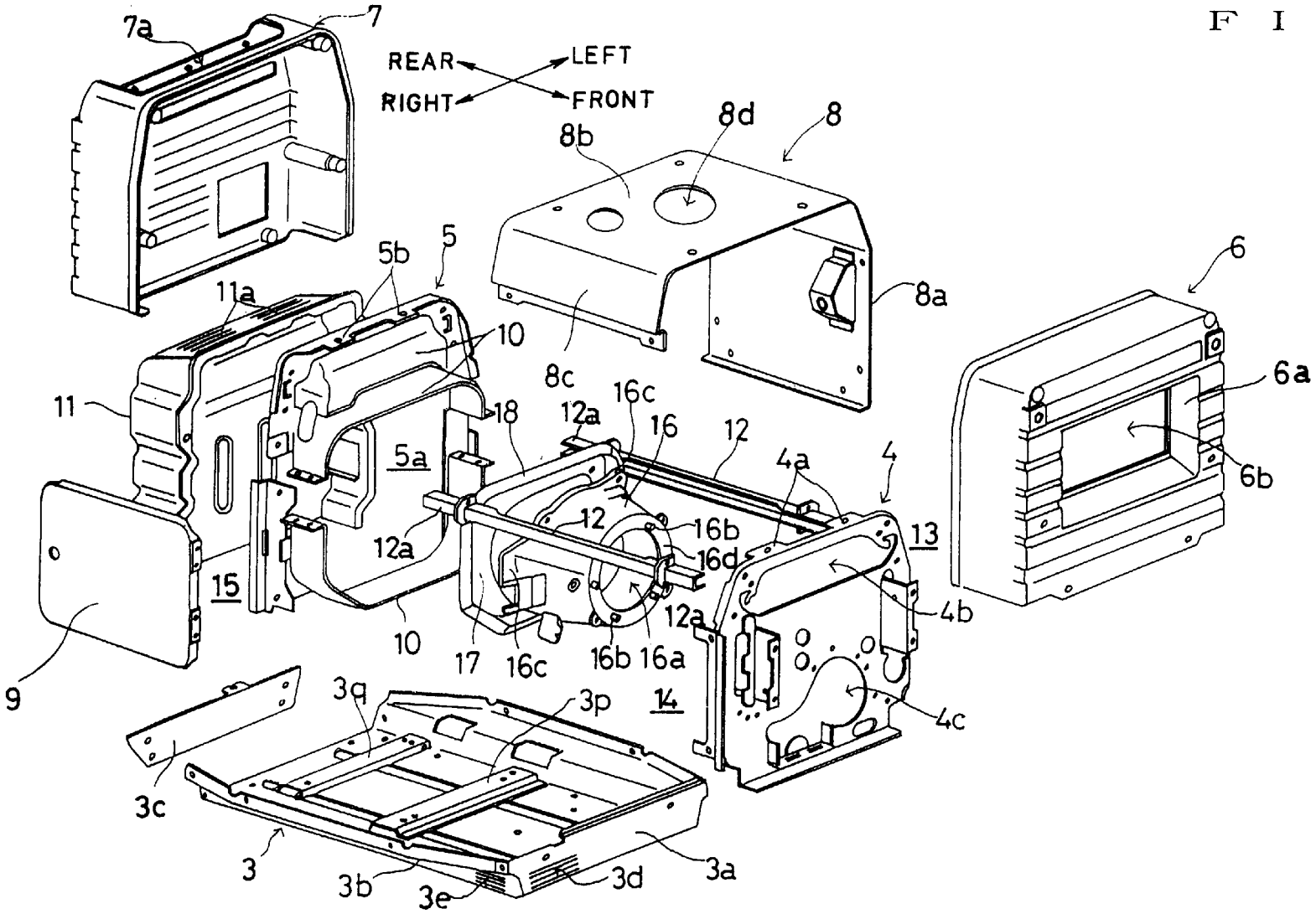
FIG. 2 is an exploded perspective view of a soundproof case of the working machine in FIG. 1.

As shown in FIG. 2, the under frame 3 has a front wall 3*a* and a right side wall 3*b* formed with respective suction ports 3*d*, 3*e* communicating with the exterior. A rear side wall 3*c* of the under frame 3 is detachable. Within the under frame 3 are laid a pair of front and rear long support members 3*p*, 3*q* in parallel with each other.

An upper marginal edge of the front frame 4 is bent rearward to form a flange 4*a*. A rectangular plate of a main part of the front frame 4 has a rectangular opening hole 4*b* formed at an upper portion and a partially swelled circular communication opening hole 4*c* formed under the opening hole 4*b*.

The rear frame 5 is divided into upper and lower pieces. When the upper and lower pieces are assembled, a large rectangular through hole 5*a* is formed at the center. The through hole 5*a* is integrally formed with a cylindrical duct 10 projected forward. An upper marginal edge of the rear frame 5 is bent forward to form a flange 5*b*.

At a center of a front wall of the front cover 6 is formed a rectangular recess 6*a*, and a rectangular opening 6*b* is formed at the recess 6*a*. In an upper wall of the rear cover 7 is formed a rectangular opening 7*a* corresponding to an exhaust air opening 11*a* of an exhaust air duct 11.

The air duct 11 disposed in rear of the rear frame 5 is made of glass wool and shaped in a rectangular box. The duct 11 is swelled rearward and communicates with a duct 10. The duct 11 opens before and down and has an upper wall formed with the exhaust air opening 11*a*.

Figure 3:
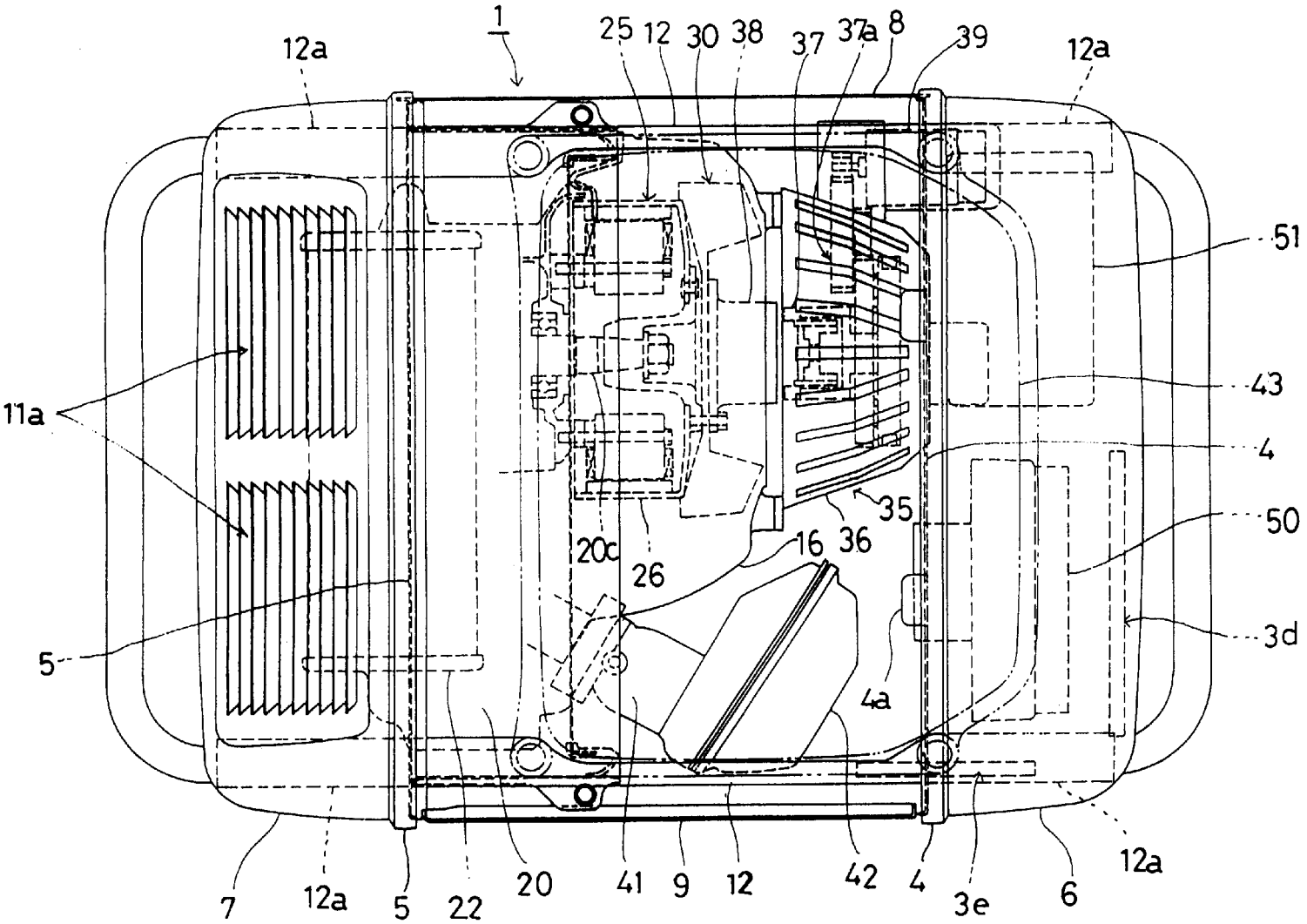
FIG. 3 is a plan view of FIG. 1 with inner structure shown in broken lines.

Between the front and rear frames 4, 5 erected on respective front and rear parts of the under frame 3 are laid a pair of right and left reinforcement rails 12 directed in the front-rear direction. As shown in FIG. 3, both front and rear ends 12*a* of the reinforcement rails 12 penetrate upper corners of the front and rear frames 4, 5 to project forward and rearward, respectively.

As shown in FIG. 2, the center cover 8 is formed in a shape of half a square pipe having a left side wall 8*a*, an upper wall 8*b* and a right upper side wall 8*c*. The upper wall 8*b* has a circular hole 8*d* in which an oil supply mouth 43*c* of a fuel tank 43 (FIG. 4) can be fitted loosely.

Figure 4:
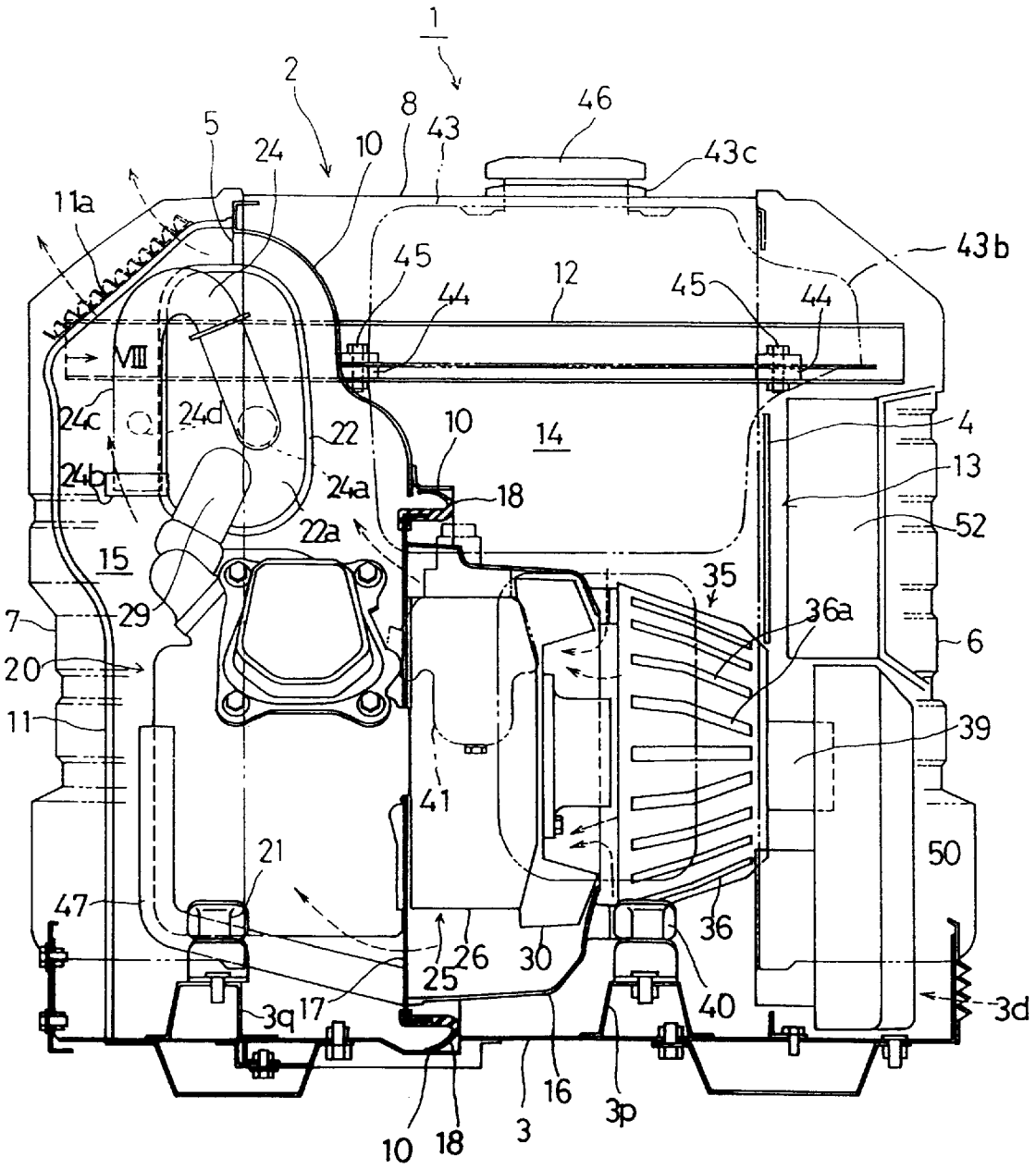
FIG. 4 is a side view of FIG. 1 with a portion of the case omitted to reveal inner structure.
Figure 5:
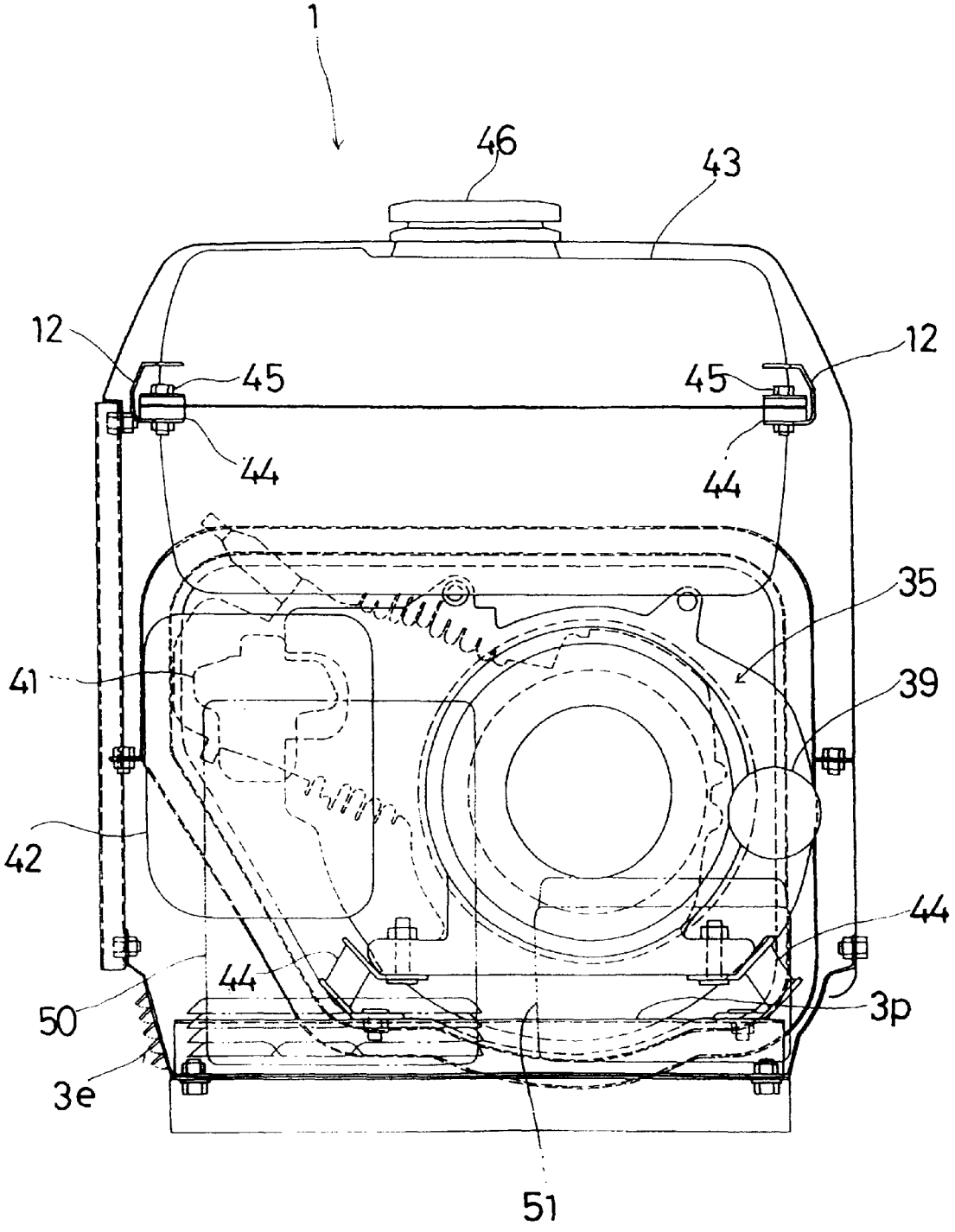
FIG. 5 is a front view of FIG. 1 with a portion of the case omitted to reveal inner structure.

As shown in FIG. 4, the space on the under frame 3 in the soundproof case 2 is divided into a front compartment 13 partitioned with the front frame 4 and the front cover 6, a center compartment 14 partitioned with the front frame 4 and the rear frame 5 and surrounded by the center cover 8 and the lid member 9, and a rear compartment 15 partitioned with the rear frame 5 and the rear cover 7. The inner surface of the rear cover 7 is lined with the exhaust air duct 11.

As shown in FIG. 2, at a rectangular pipe portion of the duct 10 projected into the center compartment 14 from the rear frame 5 is continuously provided a fan cover 16 which also forms a part of the duct. The fan cover 16 is nearly cylindrical, covers a generator 25 and a centrifugal fan 30, and has a circular suction air opening 16*a* at a front end. On an annular end surface of the suction air opening 16*a* are projected a plurality of projections 16*b* each having a predetermined length. A flange 16*c* is formed on an opening face at a rear end of the fan cover 16 extending circumferentially and a rectangular frame member 17 is attached to the flange 16*c* integrally from rear. A seal member 18 is provided along a rectangular outer marginal edge of the frame member 17 to connect the suction air opening 16*a* of the fan cover 16 with the through hole 5*a* of the rear frame 5 in an airtight manner for preventing the cooling air flowing therein from leaking out of the duct.

In the soundproof case 2, a duct space comprising the fan cover 16, the duct 10 and the exhaust air duct 11 is formed within a part of the center compartment 14 and the rear compartment 15. The suction air opening 16*a* on an upper stream side of the duct space opens toward the center compartment 14, and exhaust air opening 11*a* on the lower stream side opens toward outside of the soundproof case 2 through the upper rectangular opening 7*a* of the rear cover 7.

Figure 6:
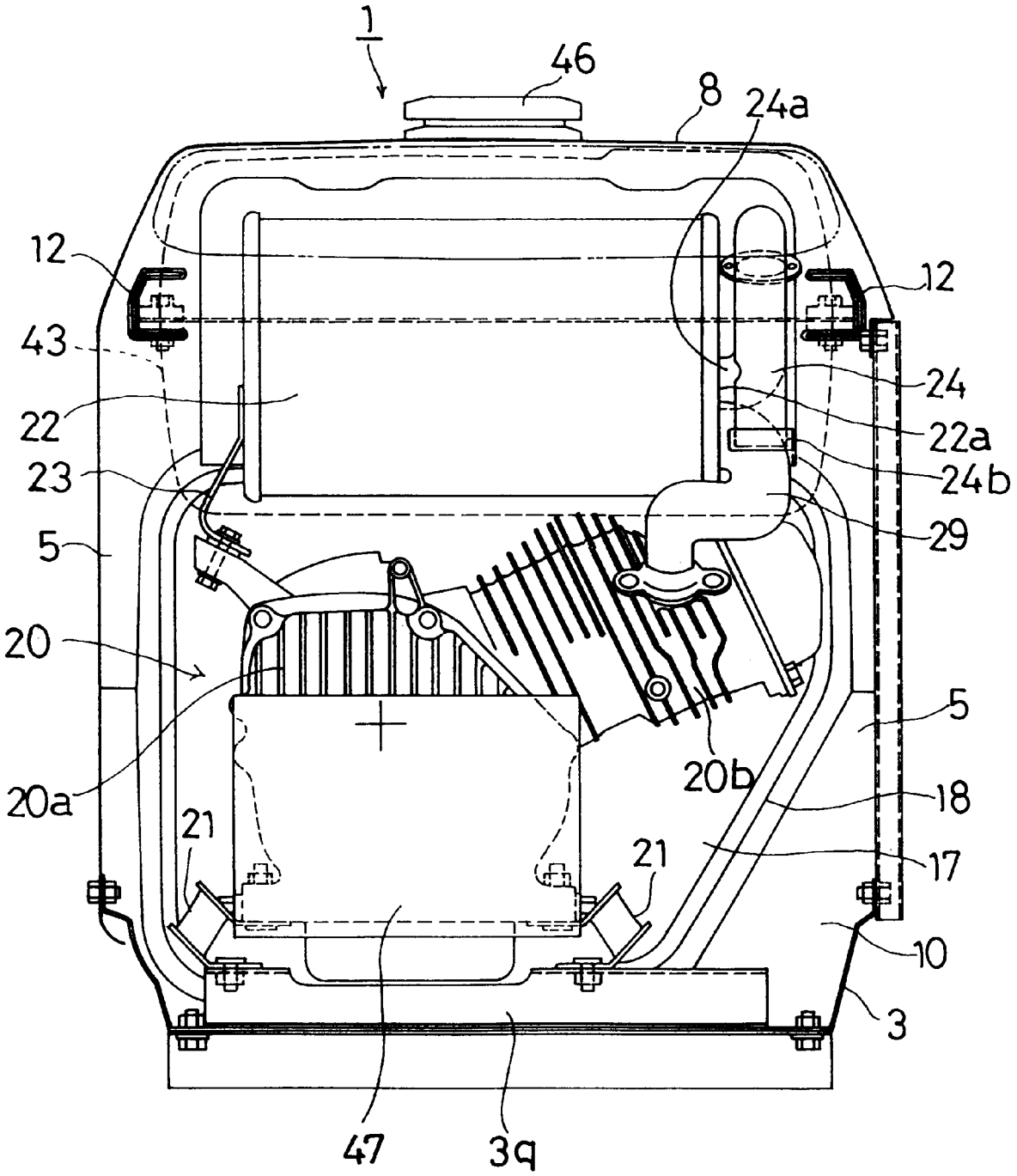
FIG. 6 is a rear view of FIG. 1 with a portion of the case omitted to reveal inner structure.
Figure 7:
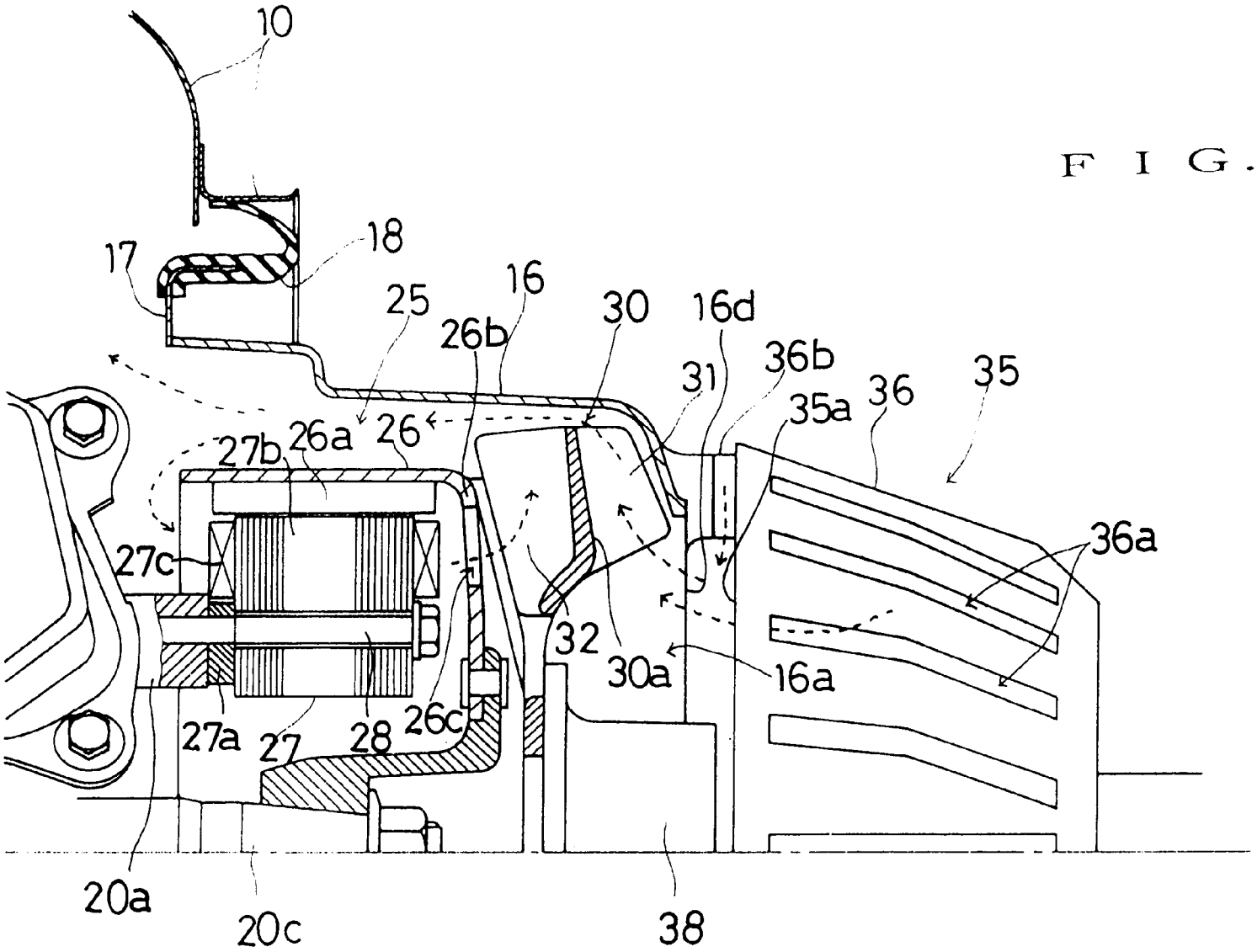
FIG. 7 is an enlarged partial longitudinal sectional side view of FIG. 4.
Figure 8:
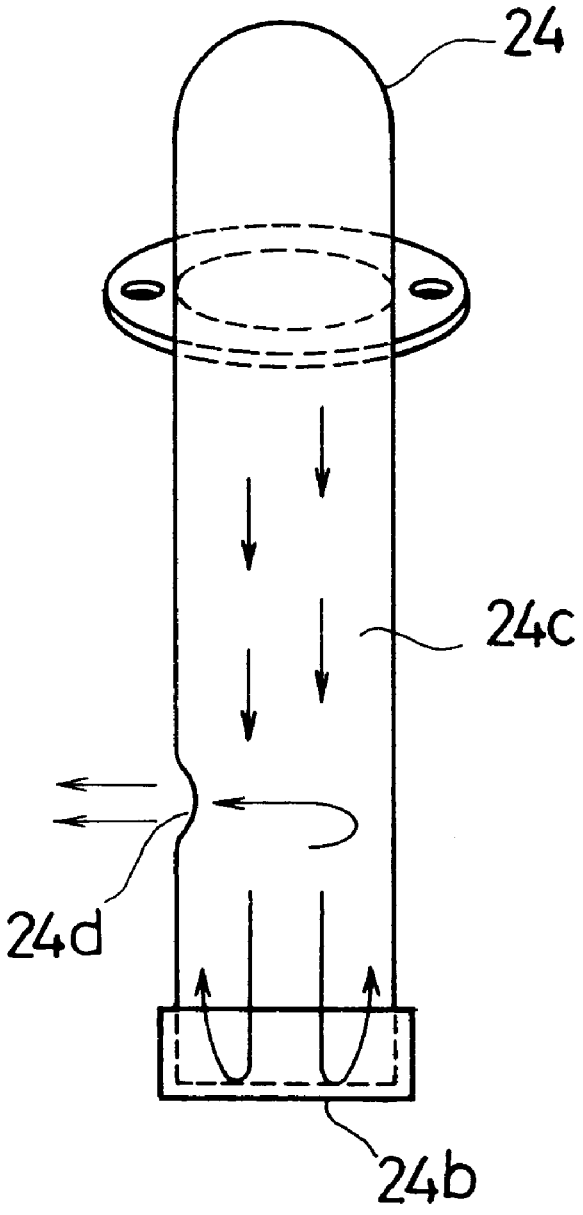
FIG. 8 is an enlarged view of an exhaust pipe in FIG. 4 viewed in the direction of arrow VIII.

An engine 20 and the generator 25 are disposed in the duct space formed by the fan cover 16, the duct 10 and the exhaust air duct 11. As shown in FIG. 4, the engine 20 is housed in the duct 10 and the exhaust air duct 11 positioned at a rear part of the soundproof case 2 and a rear part of the engine 20 is supported by the support member 3*q* of the under frame 3 through a vibration-proof mount member 21. As shown in FIGS. 6,7 the engine 20 has a crankcase 20*a* positioned biased left, a cylinder 20*b* inclined right somewhat upward, and a crankshaft 20*c* projected forward horizontally.

Above the cylinder 20*b*, a large cylindrical muffler 22 is arranged directed right and left. The cylinder 20*b* is connected with the muffler 22 through an exhaust pipe 29 extending from the cylinder upward. The muffler 22 is supported by the engine through a bracket 23. As shown in FIGS. 4 and 6, an exhaust pipe 24 having a base end 24*a* connected to a right end wall 22*a* of the muffler 22 is extended from the base end upward, then bent rearward and downward. A tip end of the exhaust pipe is closed by a lid 24*b*. At a middle of a downward hanging portion 24*c* of the exhaust pipe 24 is formed an opening 24*d* directed left.

The generator 25 is an outer-rotor type multipolar generator having an outer-rotor 26 fixed to the crankshaft 20*c* (FIG. 7). The outer-rotor 26 is formed in a bottomed cylinder shape and rotates together with the crankshaft 20*c* to act as a flywheel of the engine 20. A plurality of magnets 26*a* are fixed on an inner peripheral surface of the outer-rotor 26 arranged circumferentially.

The outer-rotor 26 has a bottom wall 26*b* positioned forwardly and opens rearward. In the outer-rotor 26 is provided an inner-rotor 27 which has a plurality of yokes 27*b* projecting from a stator core 27*a* radially. Generating coils 27*c* are wound around the yokes 27*b*. The stator core 27*a* is fixed to the crankcase 20*a* by means of bolts 28.

The bottom wall 26*b* of the outer-rotor 26 is formed with a plurality of ventilating holes 26*c* and a centrifugal fan 30 is fixedly attached to the bottom wall 26*b* from the front. The centrifugal fan 30 is a double-faced fan which has blades 31, 32 on both front and rear sides of a disk-like base plate 30*a*.

The fan cover 16 covers the generator 25 and the centrifugal fan 30, and the suction air opening 16*a* at the front end of the fan cover 16 opens opposite to the centrifugal fan 30. A rear end of the fan cover 16 is fixed to the crankcase 20*a* of the engine 20 together with the rectangular frame member 17.

A recoil starter 35 is disposed opposite to the suction air opening 16*a*. Between the open end surface 16*d* of the fan cover 16 and a rear end surface 35*a* of the recoil starter 35 is formed a gap by means of the projections 16*b* projecting forward from the end surface 16*d* of the suction air opening 16*a* (FIG. 2). A boss portion 36*b* of a starter case 36 is fixed to the fan cover 16.

The recoil starter 35 has a ratchet wheel 37 provided on a rotary shaft coaxial with the crankshaft 20*c* so as to jump out rearward. Opposite to the ratchet wheel 37, a ratchet 38 is provided at a central part of the centrifugal fan 30.

The ratchet wheel 37 is driven by a starter lever (not shown) through a gear train 37*a* or by a starter motor 39 provided at a left end of the starter case 36.

The nearly conical starter case 36 of the recoil starter 35 has a plurality of longitudinal long holes 36*a* arranged circumferentially. The outside of the starter case 36 communicates with the suction air opening 16*a* of the fan cover 16 through the gap facing the end surface of the fan cover 16*a* and the long holes 36*a*.

The recoil starter 35 is positioned in the center compartment 14 supported on the supporting member 3*p* through a pair of right and left vibration-proof mount members 46.

On the left side within the rear compartment 15 and the center compartment 14 is disposed the crankcase 20*a* of the engine 20, and in front of the crankcase 20*a* are disposed the generator 25 and the recoil starter 35. Within the center compartment 14, a carburetor 41 and an air cleaner 42 are disposed on the right side of the fan cover 16 and the recoil starter 35 with the air cleaner 42 disposed in front of the carburetor 41.

The muffler 22 is disposed above the engine 20, and a fuel tank 43 is disposed in the center compartment 14 above the fan cover 16, the recoil starter 25, the carburetor 41 and the air cleaner 42. The fuel tank 43 has a flange 44 placed on the right and left reinforcement rails 12 laid between the front and rear frames 4, 5. The fuel tank 43 is fixed to the reinforcement rails 12 by bolts 45.

As shown in FIG. 4, a front part 43*a* of the fuel tank 43 partially projects into the front compartment 13 passing through the upper opening hole 4*b* of the front frame 4 (FIG. 2). The oil supply mouth 43*c* of the fuel tank 43 projects upward passing through the circular hole 8*d* and a fuel cap 46 is screwed onto an upper end of the oil supply mouth 43*c* detachably.

Within a flat parallelepiped space of the front compartment 13 in front of the front frame 4 covered by the front cover 6, an inverter 50 and a battery 51 are disposed on the under frame 3 at the right and left sides, respectively, and a control panel 52 facing the rectangular opening 6*b* of the front cover 6 is disposed above the inverter 50 and the battery 51. Thus, electric instruments such as the inverter 50, the battery 51 and the control panel 52 are concentrated in the front compartment 13.

The inverter 50 transforms output of the multipolar generator 25 into an alternating current of a predetermined frequency.

As shown in FIGS. 4 and 6, over a rear end surface and a lower surface of the crankcase 20*a* of the engine 20 is disposed a cooling air guide plate 47 leaving a predetermined space with respect to the surfaces.

In the embodiment shown in FIGS. 1 to 8, when the engine 20 is started and the centrifugal fan 30 is in operation, a quantity of air is inhaled into the front compartment 13 within the soundproof case 2 through the suction ports 3*d*, 3*e* of the under frame 3, and another quantity of air is inhaled into the center compartment 14 within the soundproof case 2 through the suction port 3*e* of the under frame 3. The cooling air inhaled into the front compartment 13 cools the inverter 50, the battery 51 and the control panel 52 in the front compartment 13, initially.

The cooling air inhaled into the front compartment 13 then flows into the center compartment 14 through the communication hole 4*c*, joins with the cooling air inhaled into the center compartment 14 through the suction port 3*e*, and enters the fan cover 16 through the gap between the fan cover 16 and the starter case 36, the long holes 36*a* of the starter case 36 and the suction air opening of the fan cover 16, as shown in FIGS. 4 and 7 by the dotted arrows.

As shown in FIG. 7, the cooling air inhaled in the fan cover 16 by the front side blade 31 of the centrifugal fan 30 through the suction air opening 16*a* flows on the outside of the outer-rotor 26 of the generator along the inner peripheral surface of the fan cover 16 toward the engine 20 to cool it. Air within the generator 25 is inhaled onto the inner peripheral surface of the outer-rotor 26 by the rear side blade 32 of the centrifugal fan 30 passing through the inside of the outer-rotor 26 and the ventilating holes 26*c* in the bottom wall 26*b* of the outer-rotor 26. Namely, a part of the air flowing from the outer-rotor 26 toward the engine 20 is inhaled in the generator 25 to produce a circulating flow by which the generating coil 27*c* of the inner stator 27 is cooled.

Thus, air including the air which has cooled the generator 25 reaches the engine 20 to cool it, then flows toward a rear upper portion of the fan cover 16 guided by the duct 10 and the exhaust air duct 11 to cool the muffler 22. After that, the air is discharged outside of the case 2 through the exhaust air opening 11*a* of the exhaust air duct and the rectangular opening 7*a* of the rear cover 7.

The air entering the front compartment 13 through the suction ports 3*d*, 3*e* passes through gaps formed around the inverter 50 to be inhaled in the center compartment 14 through the communication hole 4*c* of the front frame 4. Thus, the front compartment 13 acts as a labyrinth introducing duct for inhaling the air so that leaking of suction sound generated in the center compartment 14 is restrained.

The generator 25, the engine 20 and the muffler 22 which are heat sources are covered by the fan cover 16, the duct 10 and the exhaust air duct 11 to be isolated from other instruments, and the air inhaled in the fan cover 16 by the centrifugal fan 30 through the suction air opening 16*a* cools the generator 25, the engine 20 and the muffler 22 in successive order of temperature, from lower to higher, before being discharged outside of the case 2 through the exhaust air opening 11*a* and rear cover opening 71. Therefore, the generator 25, the engine 20 and the muffler 22 are cooled efficiently.

Cooling air flowing along bottoms of the generator 25 and the crankcase 20*a* is guided to the rear end surface of the crankcase 20*a* by the cooling air guide plate 47, goes up along radiation blades of the crankcase 20*a*, joins with cooling air rising after being heated by the cylinder 20*a*, flows around the muffler 22 and then discharges outside through the exhaust air opening 11*a* and rear cover opening 7*a,* so that the muffler 22 is sufficiently cooled.

Exhaust gas of the engine 20 discharged into the rear compartment 15 directed left from the opening 24*d* at the middle of the downward hanging portion 24*c* of the exhaust pipe 24 crosses cooling air rising from the bottom of the engine 20 and mixes with the cooling air sufficiently, so that temperature of the exhaust gas is lowered sharply and temperature of the exhaust air discharged through the exhaust air opening 11*a* is not so high.

Noise of the exhaust gas discharged from the muffler 22 into the exhaust pipe 24 is reflected by the lid 24*b* at the lower end of the exhaust pipe to interfere with succeeding exhaust noise, so that level of noise emitted from the opening 24*d* of the exhaust pipe 24 is greatly reduced.

Since the opening 24*d* of the exhaust pipe 24 is directed to the left so as not to face on the exhaust air opening 11*a,* the opening 24*d* is not seen from the outside through the exhaust air opening 11*a* so that the engine operated generator 1 exhibits a good appearance.

Since the exhaust pipe 24 is bent into an inverted or reversed-U-shape in side view, the exhaust pipe 24 can be lengthened even if the upper space of the rear compartment 15 is not so large, therefore the exhaust gas in the exhaust pipe 24 can be sufficiently silenced and cooled within the extent of the exhaust pipe.

Since the centrifugal fan 30 is attached to the outer-rotor 26 of the generator 25, air volume of the centrifugal fan 30 is large and a large fan supporting strength can be obtained.

By covering the generator 25, engine 20 and the muffler 22 in this order by the fan cover 16, the duct 10 and the exhaust air duct 11, a simple ventilation structure is constituted. In this ventilation structure, the engine 20 is disposed in rear of the generator 25, the muffler 22 is disposed above the engine 20 and the ventilation path formed by the duct 10 and the exhaust duct 11 is bent in a U-shape. Therefore, size in front-rear direction of the soundproof case 2 can be reduced and the whole of the engine operated generator 1 can be made compact.

Since the generator 25 is an outer-rotor type generator in which the outer-rotor 26 is also used as a flywheel of the engine 20, no special flywheel is necessary and size in the direction of a rotary axis (front-rear direction) of the engine operated generator 1 can be reduced to contribute to miniaturization of it.

Since the cylinder 20*b* of the engine 20 is inclined laterally and the muffler 22 is disposed above the cylinder 20*b*, vertical size of the engine operated generator can be reduced notwithstanding that the muffler 22 has a large capacity.

The engine 20 which is a noise source is covered by a duct composed of the duct 10 and the exhaust air duct 11, which may be made of glass wool and further covered by the soundproof case 2 which surrounds the duct, so that a high soundproof effect can be obtained. Since the inverter 50 transforms output of the multipolar generator 25 into an alternating current of a predetermined frequency, it is possible to keep the rotational speed of the generator low irrespectively of fluctuation of load, in order to maintain the output frequency constant, such as with a synchronous generator which has been used in this kind of engine operated generator. Therefore, operation noise can be reduced greatly.

The engine 20 and the recoil starter 35 are integrally connected with each other by the fan cover 16, whereas the engine 20 in rear is supported by the vibration-proof mount member 21 and the recoil starter 35 in front is supported by the vibration-proof mount member 40. That is, a vibrating body is effectively supported near the front and rear ends thereof.

Within the center compartment, the fuel tank 43 and suction system instruments such as the carburetor 41 and the air cleaner 42 are disposed outside of the fan cover 16 and the duct 10. In such a manner, subsidiary parts of the engine 20 are arranged together concentrated in a place efficiently, so that the engine operated generator 1 can be made more compact.

Though an engine operated generator has been described as the preferred embodiment of the present invention, the invention can be applied to other engine operated working machine including an air compressor or a water lifting pump is driven by an engine.

Although there has been described what is at present considered to be the preferred embodiment of the invention, it will be understood that modifications and variations may be made thereto without departing from the spirit or essence of the invention. The scope of the invention is indicated by the appended claims.

What is claimed is:

1. An engine operated working machine having a soundproof case surrounding an engine and a working machine to be driven by the engine, comprising:

an exhaust compartment formed within the soundproof case, having an exhaust air opening;

means for forcing cooling air into said exhaust compartment;

a muffler disposed in said exhaust compartment; and an exhaust pipe connected to said muffler, bent in a direction away from said exhaust air opening of said exhaust compartment, and having a discharge opening positioned apart from said exhaust air opening, such that cooling air forced into said exhaust compartment flows around said muffler and said exhaust pipe to cool said muffler and said exhaust pipe, and exhaust gas discharged from said exhaust pipe into said exhaust compartment is mixed with said cooling air to change a discharging direction thereof and is then discharged outside of said soundproof case through said exhaust air opening.

2. An engine operated working machine as claimed in claim 1, wherein said discharging direction of said exhaust gas from said exhaust pipe connected to said muffler is substantially parallel with a plane of said exhaust air opening.

3. An engine operated working machine as claimed in claim 2, wherein a tip end of said exhaust pipe remote from said muffler is closed, and said discharge opening of said exhaust pipe is positioned intermediate between said muffler and said tip end.

4. An engine operated working machine as claimed in claim 1, further comprising a duct covering said engine and said muffler for thermally isolating them from other instruments within said soundproof case; one side of said duct opening inside of said soundproof case; another side of said duct, wherein said muffler is positioned, opening toward the outside of said soundproof case; and said forcing means includes a fan driven by said engine to inhale air within said soundproof case into said duct through said one side of said duct, thereby said air flows around said engine and said muffler in order to cool them, and discharges outside of said soundproof case through said another side of said duct.

5. An engine operated working machine as claimed in claim 4, wherein a cylinder of said engine is inclined laterally along a vertical plane perpendicular to a rotary axis of said engine, and said muffler is disposed in a space above said cylinder directed in a direction perpendicular to said rotary axis.

6. An engine operated working machine as claimed in claim 1, wherein said exhaust air opening is formed at an upper end of said exhaust compartment, and said exhaust pipe is bent downwardly away from the exhaust air opening.

7. An engine operated working machine as claimed in claim 1, wherein said discharge opening of said exhaust pipe is disposed below said exhaust air opening and faces in a direction within the exhaust compartment away from the exhaust air opening.

8. An engine operated working machine as claimed in claim 7, wherein said discharge opening faces in a substantially horizontal direction.

9. An engine operated working machine as claimed in claim 1, wherein said exhaust pipe is bent into a substantially inverted U-shape as viewed from a side thereof, with one end connected to said muffler and said discharge opening is disposed at an intermediate portion of one leg of the inverted U-shape.

10. An engine operated working machine as claimed in claim 1, further including means for guiding the cooling air as forced into said exhaust compartment by said forcing means toward said exhaust air opening, and said exhaust gas is discharged from said discharge opening of said exhaust pipe into a path of the guided cooling air in a direction substantially perpendicular to said path.

11. An engine operated working machine comprising:

an engine and a working machine to be driven by the engine;

a soundproof case surrounding the engine and the working machine;

an exhaust compartment formed within the soundproof case, having an exhaust air opening;

means for forcing cooling air into said exhaust compartment;

a muffler disposed in said exhaust compartment; and an exhaust pipe connected to said muffler, bent in a direction away from said exhaust air opening of said exhaust compartment, and having a discharge opening for discharging exhaust gas from the muffler within said exhaust compartment and away from exhaust air opening, such that cooling air forced into said exhaust compartment flows around said engine, said muffler and said exhaust pipe and mixes with said exhaust gas, after which the mixed exhaust gas and cooling air are discharged outside of said soundproof case through said exhaust air opening.

12. An engine operated working machine as claimed in claim 11, wherein said exhaust pipe has one end connected to said muffler and a closed opposite end, and said discharge opening is formed in an intermediate portion of said exhaust pipe.

13. An engine operated working machine as claimed in claim 11, wherein said discharge opening discharges said exhaust gas in a direction substantially parallel to a plane of said exhaust air opening.

14. An engine operated working machine as claimed in claim 11, wherein said exhaust air opening is formed at an upper end of said exhaust compartment, and said exhaust pipe is bent downwardly away from the exhaust air opening.

15. An engine operated working machine as claimed in claim 11, wherein said discharge opening of said exhaust pipe is disposed below said exhaust air opening and faces in a substantially horizontal direction.

16. An engine operated working machine as claimed in claim 11, wherein said exhaust pipe is bent into a substantially inverted U-shape as viewed from a side thereof, with one end connected to said muffler and said discharge opening is disposed at an intermediate portion of one leg of the inverted U-shape.

17. An engine operated working machine as claimed in claim 11, further including means for guiding the cooling air as forced into said exhaust compartment by said forcing means toward said exhaust air opening, and said exhaust gas is discharged from said discharge opening of said exhaust pipe into a path of the guided cooling air in a direction substantially perpendicular to said path.

* * * * *

UNITED STATES PATENT AND TRADEMARK OFFICE

CERTIFICATE OF CORRECTION

PATENT NO : 6,095,099

DATED : 01 August 2000

INVENTOR(S): Shinichi Morohoshi, Tomohiro Hirano, Ryuji Tsuru

It is certified that error appears in the above-identified patent and that said Letters Patent are hereby corrected as shown below:

Column 1, line 12, change "machine" to --machines--;
line 14, delete "on";
line 19, after "consideration" insert a comma;
line 20, after "town" insert a comma;
line 59, change "put" to --disposed--.

Column 2, line 59, change "thereby;" to --thereby,--.

Column 3, line 16, change "cooing" to --cooling--;
line 20, change "is an" to --is a--.

Column 4, line 49, after "from" insert --the--;
line 61, after "toward" insert --the--.

Column 5, line 4, after "7" insert a comma.

Column 7, 26th line, change "71" to --7a--;
line numbered 35, after "outside" insert --of the case 2--.

Column 8, line 22, after "wool" insert a comma;
line numbered between 50 and 51, change "machine" to --machines,--;
line numbered between 51 and 52, delete "is".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*